United States Patent [19]

Garofalo

[11] 4,300,413

[45] Nov. 17, 1981

[54] RATCHET WRENCH WITH ONE-HAND CONTROL AND NEUTRAL CAPABILITY

[76] Inventor: Joseph Garofalo, 50 Eder Ter., South Orange, N.J. 07079

[21] Appl. No.: 126,403

[22] Filed: Mar. 3, 1980

[51] Int. Cl.[3] ..... B25B 13/46

[52] U.S. Cl. ..... 81/62

[58] Field of Search ..... 81/61, 62, 63, 63.1, 81/63.2; 145/75; 192/43.5

[56] References Cited

U.S. PATENT DOCUMENTS

| | | | |
|---|---|---|---|
| 685,698 | 10/1901 | Sprague | 81/63 |
| 951,056 | 3/1910 | Clark | 81/63 |
| 1,164,764 | 12/1915 | Skjervem | 81/62 |
| 1,509,632 | 9/1924 | Bracci | 81/63 |
| 4,128,025 | 12/1978 | Main et al. | 81/58.1 |

*Primary Examiner*—James L. Jones, Jr.
*Attorney, Agent, or Firm*—Richard L. Cannaday

[57] ABSTRACT

A ratchet wrench which includes a pawl disposed to engage a ratchet gear carrying a drive member formed as a square shank, the pawl being selectively movable by a control rod carried in the midportion of the wrench and terminating close to its handle grasping portion and subject to digital manipulation from a grasping hand there in place. The pawl, as moved by the control rod, may be engaged with the ratchet gear to provide either clockwise or counterclockwise torque on the gear and its drive member or disengaged from the ratchet gear altogether to leave that gear and its drive member in a neutral, free-wheeling condition.

10 Claims, 9 Drawing Figures

RATCHET WRENCH WITH ONE-HAND CONTROL AND NEUTRAL CAPABILITY

BACKGROUND OF THE INVENTION

1. Field of the Invention

With reference to the classifications of art established in and by the U.S. Patent and Trademark Office, the present invention is believed to relate to subject matter found in the Class 81 titled "Tools" and Subclass 63 thereunder titled "Wrenches-pivoted pawl."

2. Description of the Prior Art

There are many ratchet wrenches shown in the documents indexed in the above-identified patent class and subclass, and generally they are shown as wrenches contemplated for clockwise and counterclockwise rotation. Ratchet drives for wrenches have been known for almost, if not more than, a century. A ratchet wrench, for example, is shown in U.S. Pat. No. 228,827 to J. A. Mell issued June 15, 1880. There a simple spring-type lever moves a pawl into one of two positions and each position is resiliently maintained. The pawl is moved selectively to allow the ratchet to provide either a clockwise or a counterclockwise motion or drive. A somewhat similar ratchet wrench is shown in U.S. Pat. No. 460,474 to O. Knapp et al. issued Sept. 29, 1981. The pivoted, resilient arm or trip-bar shown in that patent is manipulated to throw a pawl to provide either a clockwise or a counterclockwise driving effect.

In each of the prior art wrenches just cited the lever or arm whereby the selection of clockwise or counterclockwise drive is made is so positioned that it may be thrown for the selection desired without the user of the wrench having to either release his grip on the normal manual grasping portion of the wrench or use a second hand. Said in other words, the wrenches of Mell and Knapp et al. provide one-hand control for directional drive selection. Neither of those wrenches, however, has the capability in any stable sense by being placed in a neutral condition; that is, a condition in which its pawl is held out of engagement with its ratchet wheel or gear entirely and the wrench handle may be swung in either direction without imparting any significant torque to the driving member of head of the wrench, not even that required to overcome a ratchet spring effect.

There are occasions in the use of ratchet wrenches, especially working in confined areas as is often the case around automotive engines, in which screws or bolts are to be started or withdrawn while gripped only lightly by mating female threads. On such occasions or in such circumstances means must be found to prevent back-turning of the bolt or screw being withdrawn or driven while the ratchet wrench is being reset or repositioned in the course of its backswing. If the concerned bolt cannot be grasped independently by the second hand of the operator, or otherwise, it may be reversed in rotation and undesirably threaded either in or out simply on account of being too lightly held in and by the threads surrounding it for the generation of resistive torque sufficient to lift the ratchet pawl of the wrench.

Ratchet wrenches characterized by neutral or free-wheeling capability provided by various particular structures and mechanisms are shown in U.S. Pat. No. 2,376,575 to J. E. Cronan issued May 22, 1945; U.S. Pat. No. 3,677,102 to E. Simonetta issued July 18, 1972; U.S. Pat. No. 4,063,626 to D. F. Solomon issued Dec. 20, 1977, and U.S. Pat. No. 4,128,025 to H. M. Main et al. issued Dec. 5, 1978. In none of those four wrenches, however, is there the capability of one-hand control by which is meant the capability of the wrench being shifted into either clockwise drive, counterclockwise drive or neutral all by the one hand of the operator used for normal gripping and turning of the wrench while that hand is in a normal wrench-gripping position.

SUMMARY OF THE INVENTION

This invention may be summarized, at least in part, with reference to its objects.

It is an object of this invention to provide, and it does provide, a ratchet wrench which is selectively controlled to provide either a clockwise drive, a counterclockwise drive or a neutral or free-wheeling condition by movement of a knob or button which is close to the handle grasping portion of the wrench and subject to thumb or finger manipulation from the gripping or grasping hand in place.

It is a further object of this invention to provide, and it does provide, a compact and efficient ratchet wrench which includes a pawl disposed to engage a ratchet gear carrying a drive member such as a square shank, the pawl being selectively movable by a connecting control rod carried in the midportion of the wrench and configured at its end distant from the pawl to provide a post on which is mounted the aforesaid button or knob and movable in a track or slot within a cover to shift the pawl into positions or orientations appropriate to the driving and neutral conditions described in the preceding object.

BRIEF DESCRIPTION OF THE DRAWINGS

The nature and substance of the present invention as well as its objects and advantages will be more clearly perceived and fully understood by referring to the following description and claims considered in connection with the accompanying drawings in which:

In the description and claims here following various parts and the details thereof are identified by specific names for convenience. Those names are intended to be generic and also conventional in their usage. Like reference numbers designate like members or components thereof throughout the several Figures of the drawings. The drawings themselves present the preferred embodiment of the invention, i.e., apparatus now regarded as constituting the best mode of practising the invention, and to that end they disclose details of construction for purposes of illustration and explanation. Structural and mechanical details may, however, be modified to at least some extent without departing from the concept and principle of this invention, and are intended to be comprehended by it, especially as the invention is claimed hereinafter.

DESCRIPTION OF THE PREFERRED EMBODIMENT

Figure 1:
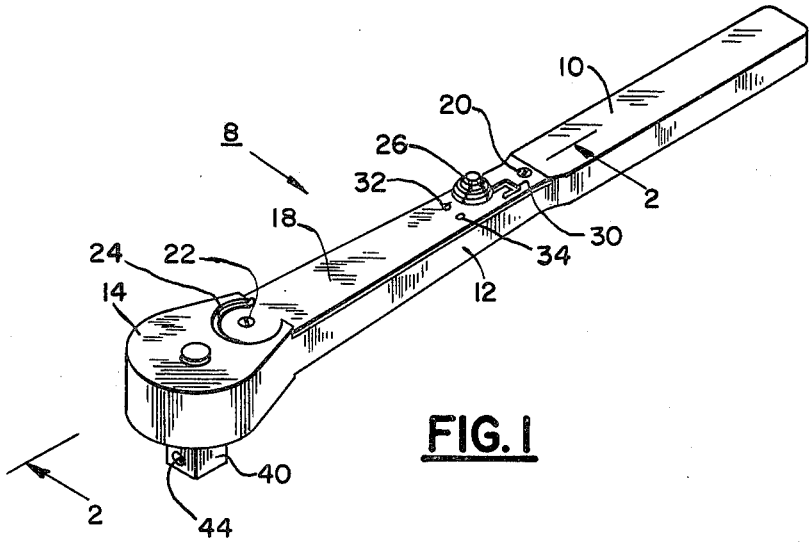
FIG. 1 is an isometric view of a ratchet wrench according to this invention showing the control button for manipulation of the ratchet pawl and a portion of the track or path according to which that button may be moved.
Figure 2:
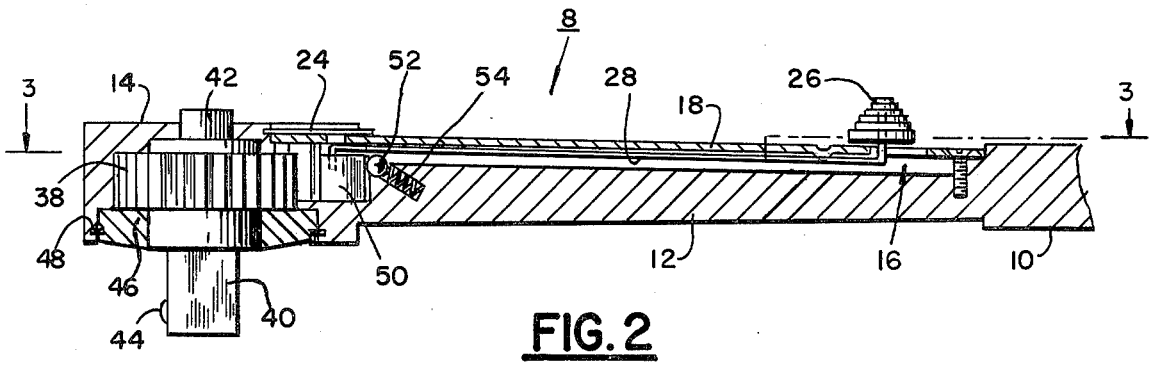
FIG. 2 is a fragmentary view of the ratchet wrench of FIG. 1 generally forward of the gripping or grasping portion thereof taken in sectional elevation along line 2—2 in FIG. 1 looking in the direction of the arrows.
Figure 3:
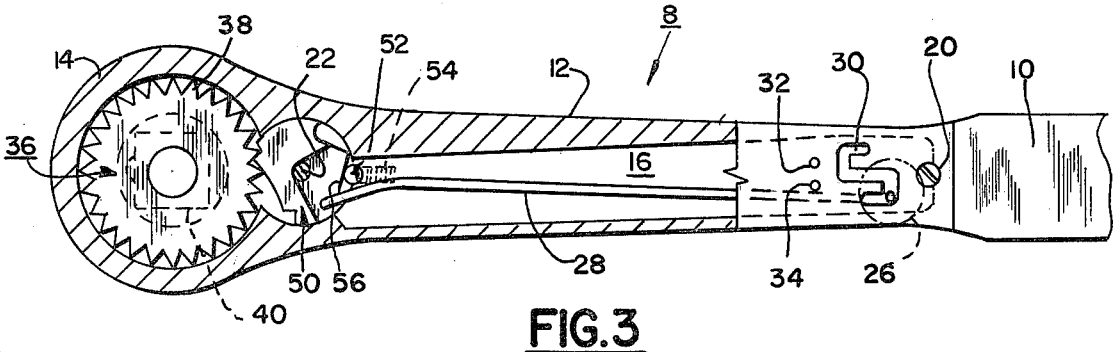
FIG. 3 is a substantially sectioned plan view of the ratchet wrench fragment of FIG. 2 taken along line 3—3 therein looking in the direction of the arrows.

Referring now to the drawings in detail, especially to FIG. 1 thereof, the illustrated ratchet wrench generally designated 8 is of substantially conventional configuration and comprises a unitary, elongated shank or body or housing. That element includes a handle portion 10, a midportion 12 and a head portion 14. Within that head portion there are retained a ratchet gear and a drive member hereinafter more fully described. As shown in FIGS. 2 and 3, midportion 12 is characterized by an elongated recess region 16. Above that region, and shown clearly in FIG. 1, there is a cover plate 18 which is retained in place on the shank or body of the wrench by screws 20 and 22 and snap ring 24. Screw 22 also serves as a pivot for the ratchet pawl shown in FIGS. 2 and 3.

Resting upon and projecting above cover plate 18 is a knob or button 26 which is mounted on a upturned end portion of control rod 28 shown in FIGS. 2 and 3. Partly visible in FIG. 1, although partly obscured there by button 26, is an S-shaped slot 30 in cover plate 18 through which the aforesaid upturned end of control rod 28 projects and in which that rod end may be moved by manipulation of button 26. The proximity of button or knob 26 to handle portion 10 of wrench 8 should be noted. For manipulation purposes, that button is within easy thumb reach of a user of the wrench having a normal grasp thereon. Also visible in FIG. 1 are two depressions 32 and 34 in the upper surface of cover plate which appear as dimples on the lower surface of that plate, and there serve a detent function for control rod 28 as that rod is snapped beyond and between them as it is given some side-to-side or angular motion by manipulation of button 26.

Referring next to FIGS. 2 and 3, there is a ratchet gear generally designated 36 disposed rotatably within wrench head portion 14. That gear has teeth 38 around its full circumference. It is formed essentially unitarily with rectangular driving member 40 which has a conventional mechanism of a coaxial spring-loaded plunger 42 and a laterally exposed detent ball 44 associated with it for the retention and release of socket and other fittings. Above and below its toothed region the gear is provided with hub portions which to some extent serve as locating means. The upper hub portion is accommodated in a recess provided in head portion 14 while the lower hub portion is accommodated in the bore of a retainer ring or plate 46. That plate in turn is secured in position by a snap ring 48 fitted into a mating groove in head portion 14.

A ratchet pawl 50 pivoted on screw 22 is conventionally disposed within a recess in the wrench shank or body adjacent and in effect representing a continuation of the recess therein accommodating ratchet gear 36. Elongated recess region 16 wherein control rod 28 is disposed extends from the pawl recess, and the control rod itself at its end distant from knob or botton 26 is bent down and with a free-turning fit therein is received in a hole provided in the ratchet pawl. Thus pawl 50 and control rod 28 are in pivoted engagement. Local relief is given to the upper surface of the pawl to permit the control rod to come in relatively low upon it below cover plate 18. A detent ball 52 is carried in a recess or groove formed generally below recess region 16 at one end thereof and opening into the recess for ratchet pawl 50. That ball is urged or biased toward and held in contact with the pawl by compression spring 54 in the aforementioned ball groove or recess. The surface 56 of the pawl upon which ball 52 bears is contoured in part as two intersecting planes defining a rather sharp angle at their meeting line or apex. Distantly from that apex those planes terminate in surfaces curved outwardly toward the surrounding surfaces of the recess within which the pawl 50 is disposed and within which it can be given angular motion.

At opposite ends of its more-or-less plane surface diametrally across from ball-engaging surface 56, the ratchet pawl is characterized by stepped or notched regions for engagement with teeth 38 of ratchet wheel or gear 36. Engagement of one or the other of those notched regions with a tooth or teeth of gear 36 is maintained or tended to be maintained by the spring-biased action of ball 52 upon one or the other of the planes of surface 56. It is to be understood that the general arrangement of ratchet gear 36, ratchet pawl 50, detent ball 52, and ball spring 54 is, by itself, substantially conventional. Likewise the means including retainer plate 46 and snap ring 48 for keeping ratchet gear 36 in place is not deemed independently inventive. Invention is considered to lie essentially in the arrangement exemplified through control rod 28 and button 26 for effecting angular movement of pawl 50 for achievement of the objects stated hereinbefore.

Figure 4A:
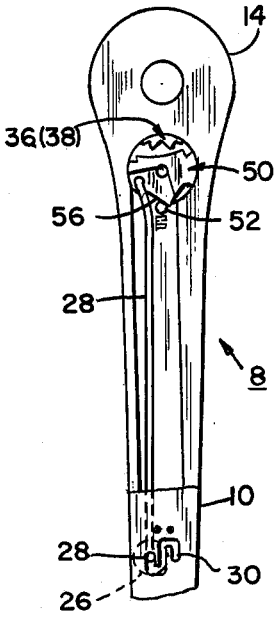
FIGS. 4A, 4B, 4C, 4D, 4E and 4F are fragmentary plan views of the ratchet wrench of FIG. 1 with its mechanism partly exposed showing the control rod shifted through a series of positions or conditions according to manipulation of the knob or button at one end thereof whereby the ratchet pawl is positioned correspondingly in a series of neutral and driving dispositions or angulations.

Referring next to FIG. 4A, the upturned end of control rod 28 on which button 26 is mounted is shown moved to the left and as far as it will go in that condition in S-shaped slot 30 toward head portion 14 of wrench 8. The control rod as a whole lies to the left of detent dimple 34 and ratchet pawl 50 is disengaged entirely from ratchet gear 36 to give a condition of neutrality of the wrench in which the ratchet gear and its included driving member 40 may turn or be turned entirely freely either clockwise or counterclockwise with respect to the remainder of the wrench structure, or, viewed in the opposite sense, the remainder of the wrench structure may be swung freely either way around the gear. In order to maintain rod 28 and pawl 50 in their disposition shown in FIG. 4A some forward thrust or force may need to be held on the control rod through pressure on knob or button 26 to work against the effect of spring-loaded ball 52 tending to turn the ratchet pawl counterclockwise and into engagement with teeth 38 of ratchet gear 36.

Figure 4B:
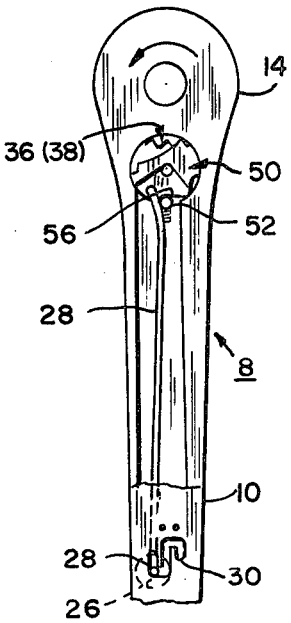

Referring next to FIG. 4B, control rod 28 has been pulled back, or allowed to move back under the influence of ball 52, as far as its upturned end in the left hand vertical pass of slot 30 will go toward handle portion 10 of wrench 8. That has brought pawl 50 into engagement with gear 36 for counterclockwise driving of and by wrench 8 as indicated by the arrow on head portion 14 with conventional ratchet effect on the back or clockwise swing of the wrench. As back ratcheting takes place in the course of usage of the wrench the upturned end of control rod 28 will perform slight reciprocating motion between the bottom of the left hand vertical pass of slot 30 and a point part way up that pass as the control rod is moved with and by ratchet pawl 50 as that pawl oscillates about its pivot screw 22. That reciprocating motion will be visible as motion of button 26. In particular, however, it may be seen that by manipulation of button 26 to move back and forth between the conditions of FIGS. 4A and 4B it is possible to have a counterclockwise driving swing or stroke of wrench 8 with a neutral or free-wheeling back swing.

Figure 4C:
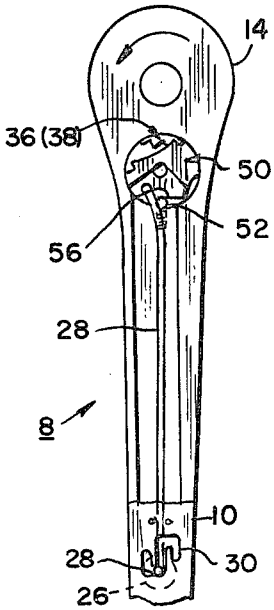

Referring next to FIG. 4C, the upturned end of rod 28 near wrench handle portion 10 is at the bottom of the central vertical pass of S-shaped slot 30. In the course of going from the condition of FIG. 4B to that of FIG. 4C button 26 has been pushed to the right and the control rod snapped under detent dimple 34 to be disposed between dimples 34 and 32. The wrench is still in condition for counterclockwise driving and customary back ratcheting. As back ratcheting takes place in the course of usage of the wrench the upturned end of control rod 28 will perform slight reciprocating motion from the bottom of the central vertical pass of slot 30 to a point part way up that pass. Just as before, that motion will be visible as motion of button 26.

Figure 4D:
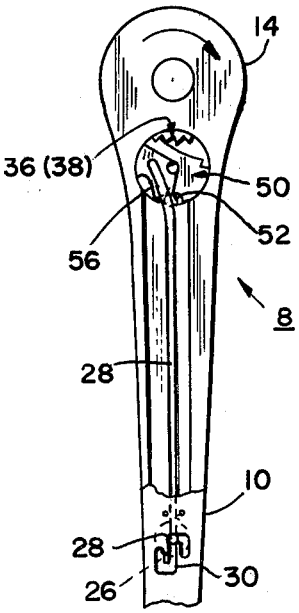

Referring next to FIG. 4D, control rod 28 has been pushed up by manipulation of button 26 to bring the upturned end of that rod to the top of the central vertical pass of slot 30. In the course of that movement of the rod, i.e., going from the condition of FIG. 4C to that of FIG. 4D, ratchet pawl 50 has been rotated clockwise sufficiently that the apex of the intersecting planes of pawl surface 56 on which spring-loaded detent ball 52 acts has been shifted across that ball so that the ball bears on the plane other than the one on which it bore with the wrench in its conditions of FIGS. 4A, 4B and/or 4C. In the showing of FIG. 4D the ratchet pawl has been brought into engagement with the ratchet gear for clockwise driving of and by wrench 8 as indicated by the arrow on head portion 14 with conventional ratchet effect on the back or counterclockwise swing of the wrench. As back ratcheting takes place in the course of usage of the wrench the upturned end of control rod 28 will perform slight reciprocating motion from the top of the central vertical pass of slot 30 to a point part way down that pass. Just as before, that motion will be visible as motion of button 26.

Figure 4E:
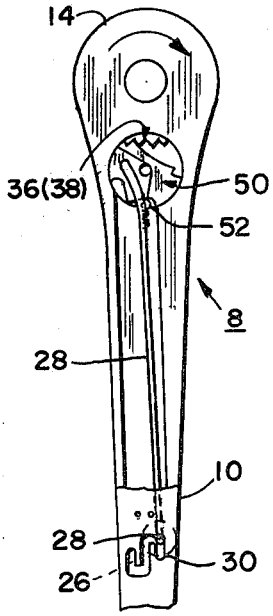

Referring next to FIG. 4E, the upturned end of control rod 28 near handle portion 10 is at the top of the right hand vertical pass of S-shaped slot 30. In the course of going from the condition of FIG. 4D to that of FIG. 4E button 26 has been pushed to the right and the control rod snapped under detent dimple 32 to lie to the right of that dimple. The wrench is still in condition for clockwise driving and customary back ratcheting. As back ratcheting takes place in the course of usage of the wrench the upturned end of control rod 28 will perform slight reciprocating motion from the top of the right hand vertical pass of slot 30 to a point part way down that pass. Just as before, that motion will be visible as motion of button 26.

Figure 4F:
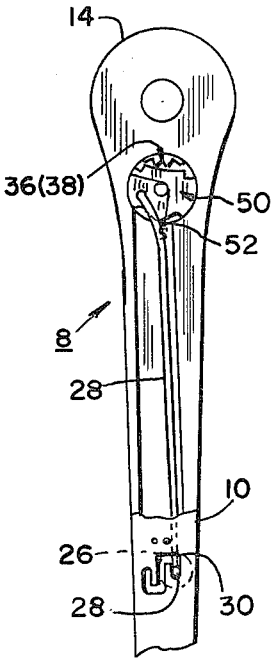

Referring finally to FIG. 4F, control rod 28 has been pulled down or back by manipulation of button 26 to bring the upturned end of that rod to the bottom of the right hand vertical pass of slot 30. In the course of that movement of the rod, i.e., going from the condition of FIG. 4E to that of FIG. 4F, ratchet pawl 50 has been rotated counterclockwise sufficiently to disengage it entirely from ratchet gear 36. That provides a condition of neutrality of the wrench in which the ratchet gear and its included driving member 40 may turn or be turned entirely freely either clockwise or counterclockwise with respect to the remainder of the wrench structure. To that extent the conditions of FIGS. 4A and 4F are similar. In order to maintain rod 28 and pawl 50 in their disposition shown in FIG. 4F some rearward pull may need to be held on the control rod through pressure on button 26 to work against the effect of spring-biased ball 52 tending to turn the ratchet pawl clockwise and into engagement with teeth 38 of ratchet gear 36. Particularly, however, it may be seen that by manipulation of button 26 to move back and forth between the conditions of FIGS. 4E and 4F it is possible to have a clockwise driving swing or stroke of wrench 8 with a neutral or free-wheeling back swing.

Conclusion

The preferred embodiment of the present invention shown in the drawings just described may be changed to a limited extent in various particular ways without altering the concept of thumb or finger, i.e., digital, control of the ratchet pawl from a point at or close to the handle portion of the wrench. For example, cover plate 18 may be omitted and control rod 28 carried in a substantially open recess 16 with suitable means not now shown provided to prevent the control rod from falling away from the main structure of the wrench in any orientation or attitude thereof. For a further example, the upturned end of rod 28 and button 26 thereon may be made shiftable simply in a more-or-less straight line to move the control rod forwardly and backwardly and bring ratchet pawl 50 to the positions shown. A midtravel detent for the rod or button would be desirable in that circumstance for identification of the neutral or free-wheeling position. Detent ball 52 and ball spring 54 could even be omitted and their biasing effect on ratchet pawl 50 achieved by digital thrust maintained suitably on control rod 28.

Possible modifications of the preferred embodiment of this invention as suggested just above are not contemplated to change in either principle or practical operation the unique technique and mechanism of control of the ratchet wrench illustrated and described. Terms such as "left," "right," "up," "down," "bottom," "top," "front," "back," "clockwise," "counterclockwise," and the like are applicable to the embodiment of the invention shown in the drawings and described on the basis thereof. Those terms are, however, employed in the fashion indicated simply for purposes of particular, detailed explanation, and do not control the position, orientation, attitude or any other parameter or circumstance of construction and/or use of the wrench.

Protection by Letters Patent of this invention in all its aspects as the same are set forth in the appended claims is sought to the broadest extent that the prior art allows.

I claim as my invention:

1. A ratchet wrench selectably controllable for rotating a drive member thereof either clockwise or counterclockwise and also providing free-wheeling of that drive member with selection being effected immediately by means close to the normal handle grasping portion of the wrench, said wrench comprising (1) a body including a head portion, a midportion and a handle portion; (2) a ratchet gear disposed on said body at the head portion thereof, that gear having teeth on its outer periphery and further having a drive member extending coaxially from it, substantially normally to said body; (3) means retaining said ratchet gear rotatably on said body; (4) a ratchet pawl disposed on said body adjacent said ratchet gear, that pawl being configured to engage that gear at the teeth thereof to rotate the same and the drive member extending therefrom either clockwise or counterclockwise and also to remain in a neutral, disengaged condition with respect to the ratchet gear whereby that gear and its drive member are left free-wheeling with respect to said body; (5) means retaining said ratchet pawl on said body and permitting rotation of that pawl to achieve the aforesaid conditions of engagement and disengagement of the same with respect to the ratchet gear, and (6) a control rod means connected to said pawl at one side thereof and extending therefrom along and within said midportion of said body and terminating close to said handle portion thereof and at its end close to said handle portion being configured to render it subject to thumb manipulation from a grasping hand in place on said wrench, said control rod means movable substantially longitudinally to rotate said ratchet pawl to achieve the aforesaid conditions of engagement and disengagement thereof with respect to said ratchet gear.

2. A ratchet wrench according to claim 1 which further comprises biasing means disposed on said body and bearing upon said ratchet pawl on a surface thereof so configured that said biasing means tends to maintain said pawl in either of its conditions of engagement with said ratchet gear as the same exists.

3. A ratchet wrench according to claim 1 which further comprises guidance means for the end of said control rod means close to the handle portion of said body whereby thumb manipulation of said rod means end to positions corresponding to particular conditions of engagement and disengagement of said ratchet pawl with and from said ratchet gear is facilitated.

4. A ratchet wrench according to claim 1 in which said body is recessed to accommodate said ratchet gear, said ratchet pawl and said control rod means with the end of said control rod means close to said handle portion having an upturned configuration.

5. A ratchet wrench selectably controllable for rotating a drive member thereof either clockwise or counterclockwise and also providing free-wheeling of that drive member with selection being effected immediately by means close to the normal handle grasping portion of the wrench, said wrench comprising (1) a body including a head portion, a midportion and a handle portion; (2) a ratchet disposed on said body at the head portion thereof, that gear having teeth on its outer periphery and further having a drive member extending coaxially from it, substantially normally to said body; (3) means retaining said ratchet gear rotatably on said body; (4) a ratchet pawl disposed on said body adjacent said ratchet gear, that pawl being configured to engage that gear at the teeth thereof to rotate the same and the drive member extending therefrom either clockwise or counterclockwise and also to remain in a neutral, disengaged condition with respect to the ratchet gear whereby that gear and its drive member are left free-wheeling with respect to said body; (5) means retaining said ratchet pawl on said body and permitting rotation of that pawl to achieve the aforesaid conditions of engagement and disengagement of the same with respect to the ratchet gear; (6) a control rod engaged with said ratchet pawl and extending therefrom along said midportion of said body and terminating close to said handle portion thereof and at its end close to said handle portion having an upturned configuration to render it subject to digital manipulation from a grasping hand in place on said wrench whereby said control rod may be moved to rotate said ratchet pawl to achieve the aforesaid conditions of engagement and disengagement thereof with respect to said ratchet gear, said body being recessed to accommodate said ratchet gear, said ratchet pawl and said control rod, and (7) a cover plate extending at least part way over the body recess in which said control rod is accommodated, that cover plate being characterized by a slot through and above which said upturned end of the control rod extends with that slot being configured as guidance means for said rod end whereby digital manipulation of the same to positions corresponding to particular conditions of engagement and disengagement of said ratchet pawl with and from said ratchet is facilitated.

6. A ratchet wrench according to claim 5 in which said cover plate slot is substantially S-shaped.

7. A ratchet wrench according to claim 5 which further comprises a button on the extent of the upturned end of said control rod above said cover plate whereby digital manipulation of the control rod is facilitated.

8. A ratchet wrench according to claim 5 in which said cover plate is characterized by at least one protrusion on its lower surface, that protrusion extending into the body recess in which said control rod is accommodated and acting as lateral guidance means for that rod.

9. A ratchet wrench according to claim 8 in which said protrusion is formed integrally with said cover plate from a depression made in the upper surface of that plate.

10. A ratchet wrench according to claim 8 in which there are two said protrusions on the lower surface of said cover plate disposed to have said control rod work between them and on either side of both of them in a range of angulations, snapping beneath and past those protrusions from angulation to angulation in detent action.

* * * * *